United States Patent [19]

McMullan et al.

[11] 4,270,040

[45] May 26, 1981

[54] HEATER WITH REINFORCING STRATE

[76] Inventors: James P. McMullan; Albert Stevens, both of 2630 Seaman Ave., El Monte, Calif. 91733

[21] Appl. No.: 86,400

[22] Filed: Oct. 19, 1979

[51] Int. Cl.[3] ..... H05B 3/34

[52] U.S. Cl. ..... 219/528; 219/212; 219/510; 219/530; 219/544; 219/549; 219/541

[58] Field of Search ..... 219/211, 212, 345, 494, 219/510, 512, 516, 527, 528, 529, 540, 535, 540, 541, 544, 548, 549; 338/212; 126/256, 399

[56] References Cited

U.S. PATENT DOCUMENTS

| | | | |
|---|---|---|---|
| 2,018,512 | 10/1935 | DeLaney et al. | 219/528 |
| 2,114,396 | 4/1938 | McFarlan | 219/528 |
| 2,961,522 | 11/1960 | Hammer | 219/541 |
| 3,657,517 | 4/1972 | Hoyt | 219/535 |
| 3,790,753 | 2/1974 | Miller | 219/528 |
| 3,904,850 | 9/1975 | Johnson | 219/528 |
| 4,139,763 | 2/1979 | McMullan et al. | 219/528 |
| 4,149,066 | 4/1979 | Niibe | 219/505 |

*Primary Examiner*—Volodymyr Y. Mayewsky

[57] ABSTRACT

A flat normally horizontal electric resistance blanket heater comprising a thin, fragile elongate resistance element established on one surface of and carried by a thin, flexible film of dielectric material, a thin, flat resilient and flexible reinforcing strate of dimensionally stable material retained adjacent the other surface of the film to allow for controlled flexure of the heater and prevent dimensional distortion of the film and element and an envelope of flexible dielectric plastic film encapsulating the film, element and strate.

The heater also includes temperature responsive switching means responsive to the temperature of heated portions of the heater and in temperature insulated relationship from a portion of the heater where the element connects with power supply lines and which creates a portion in the heater of greater mass and heat storing capacity.

8 Claims, 10 Drawing Figures

-17-
-17-

HEATER WITH REINFORCING STRATE

This invention has to do with blanket-type resistance heaters and is particularly concerned with an improved blanket type heater with novel reinforcing and temperature control means.

In the art of blanket-type heaters, there is great need for thin, flexible, inexpensive heaters which are such that they can be subjected to intermittent flexure by the directing of external forces therethrough.

More particularly, there is great need for a flexible heater structure of the character referred to which can be advantageously arranged and used in combination with flexible, yielding and/or movable structures. For example, there is a need for a flexible blanket-type heater to heat water bed mattresses which are supported by resilient foam plastic pads and wherein the heater is arranged between the bottom of the mattress and the top of the underlying supportive pad. In such a combination and relationship of parts, the flat, flexible blanket-type heater, between the mattress and the pad, is subject to being flexed and bent when the weight of a person atop the mattress is exerted downwardly in the area or zone in which the heater occurs to cause "bottoming out" of the mattress, yielding compaction of the pad and flexing of the heater therebetween.

Flexure of a flat, horizontal blanket-type heater in the manner set forth above results in the distribution of resolved compressive and/or tensile forces throughout the plane of the blanket heater structure which tend to stretch, tear, break, wrinkle and otherwise adversely affect the resistance element within the heater structure, which element is commonly in the form of an elongate, thin or fine wire or ribbon of electrically resistive metal arranged in a zig-zag or serpentine manner within the heater structure.

In the prior art, in some instances where blanket-type resistance heaters are to be subjected to flexure in the manner noted above, the elements of the heater have been established of heavy jacketed reinforced wire type resistance elements hand-laid and loosely arranged within the other related parts of the heater structures so that the elements are capable of moving relative to the said other parts and can withstand anticipated tensioning when the heaters are flexed. Such a heater structure is disclosed in our U.S. Pat. No. 4,220,848; for WATER BED HEATER, issued Sept. 2, 1980.

While the heater structures such as disclosed in our above patent are desirable and effective, they require the utilization of heavy and costly materials, require considerable hard work in the course of their manufacture, are heavy and bulky and are necessarily so costly that their practical use is limited to those situations where their cost is not a major factor or cannot be avoided.

In the art of flexible blanket-type heaters, a form of resistance element has recently been developed which lends itself to mass production at low cost and which is such that it lends itself to being incorporated in a related heater structure in an extremely efficient and economical manner.

The new form of resistance elements noted above comprises a flat, thin and flexible film of thermoset plastic, such as Mylar, on which the thin foil of aluminum has been cemented and wherein portions of the foil have been removed by a suitable masking and etching process; whereby the resulting resistance element is an elongate thin and delicate foil ribbon (substantially incapable of freely supporting itself) supported on the surface of and carried by the plastic film. This new form of plastic film supported metal foil ribbon resistance element is engaged within an insulative and protective envelope of flexible plastic sheeting.

The above noted form of heater construction as disclosed in U.S. Pat. No. 4,139,763 has been proven to be extremely effective and dependable in operation and is extremely economical to manufacture. The noted patented heater structure is being mass-produced and is used in these situations where the heater is static when in use, that is, where it is not subjected to being bent, flexed and otherwise physically worked.

It has been determined that when the noted patented heater is subjected to repeated tensioning and working when in use, the foil element is readily stretched, torn, broken or otherwise adversely affected to the end that the heater is rendered inoperative.

OBJECTS AND FEATURES OF THE INVENTION

An object of the present invention is to provide a flexible blanket-type heater including a thin metal foil heating element on a thin, flexible plastic carrier film and a thin, flat, dimensionally stable reinforcing plate or strate related to the carrier film, whereby the film and the element are not subject to tensile and bending forces likely to damage or adversely affect the element when the heater structure is subjected to externally applied forces which flex and bend the heater structure.

It is an object and feature of this invention to provide a heater structure of the general character referred to above wherein the reinforcing strate comprises a thin, flat, flexible sheet of substantially non-ductile resilient material such as spring metal, resilient plastic resin sheeting, fiberglas reinforced resin sheeting and the like.

Another object and feature of the invention is to provide a heater of the character referred to wherein the resilient reinforcing strate is adjacent and bonded to the surface of the carrier film opposite the surface of the film with which the element is related, by a flexible cement or bonding agent, whereby the strate and element are electrically insulated from each other by the film and the cement and so that the film is dimensionally stably supported by the strate.

Yet another object and feature of the invention is to provide a heater structure of the character referred to wherein the film, strate and element assembly is within a hermetically sealed envelope of thin, flexible, electric insulative, plastic sheet material.

It is an object and feature of the present invention to provide a heater structure of the character referred to above wherein the adjacent opposing surfaces of the envelope, strate, film and element are bonded together by an electrically non-conductive, flexible cement or bonding agent whereby the several laminates establish an integrated structure wherein the several laminates are supported by each other and each lends dimensional stability to the other.

It is an object and feature of the invention to provide the heater structure of the general character referred to above wherein the metal reinforcing strate is a heat conductive heat distributing part which serve to conduct and distribute heat generated in the structure substantially uniformly throughout the effective heating plane of the structure.

Another object of the invention is to provide a heater of the character referred to including novel temperature sensing and/or control means to sense the temperature of the heater and to control the supply of current to the element.

It is an object of the present invention to provide a structure of the character referred to above including an elongate, flexible power supply cord and coupling means coupling the conductors of the cord with terminals on the element and connecting means connecting the control means in and with the conductors; said coupling and connecting means are arranged and positioned within a limited predetermined area within the surface area of the heater structure and are retained and protected within a body of insulative potting material on the heater whereby the greater bulk and mass afforded by said means and the potting material is concentrated within a limited predetermined area of the heater structure.

It is an object of this invention to provide a heater of the character referred to wherein the heating element does not occupy and is spaced from the area of greater mass established by and about the coupling and connecting means.

It is an object and feature of the present invention to provide temperature sensing and control means including one or more temperature sensing devices arranged adjacent portions of the heater directly related to the element of the heater and remote from the area of greater mass and a structure including heat barrier means in the metal strate between the area of greater mass and the temperature sensing devices whereby the devices are thermally remote or isolated and their operation is not notably or adversely affected by heat flowing to and from the area of greater mass.

An object of the invention is to provide a structure of the character referred to wherein the heat barrier means includes elongate slot-like through openings in the metal strate about the perimeter of the area of greater mass.

The foregoing and other objects and features of our invention will be fully understood from the following detailed description of a typical preferred form and embodiment of the invention throughout which description reference is made to the accompanying drawings.

DETAILED DESCRIPTION OF THE INVENTION

Figures 1, 2, 3:
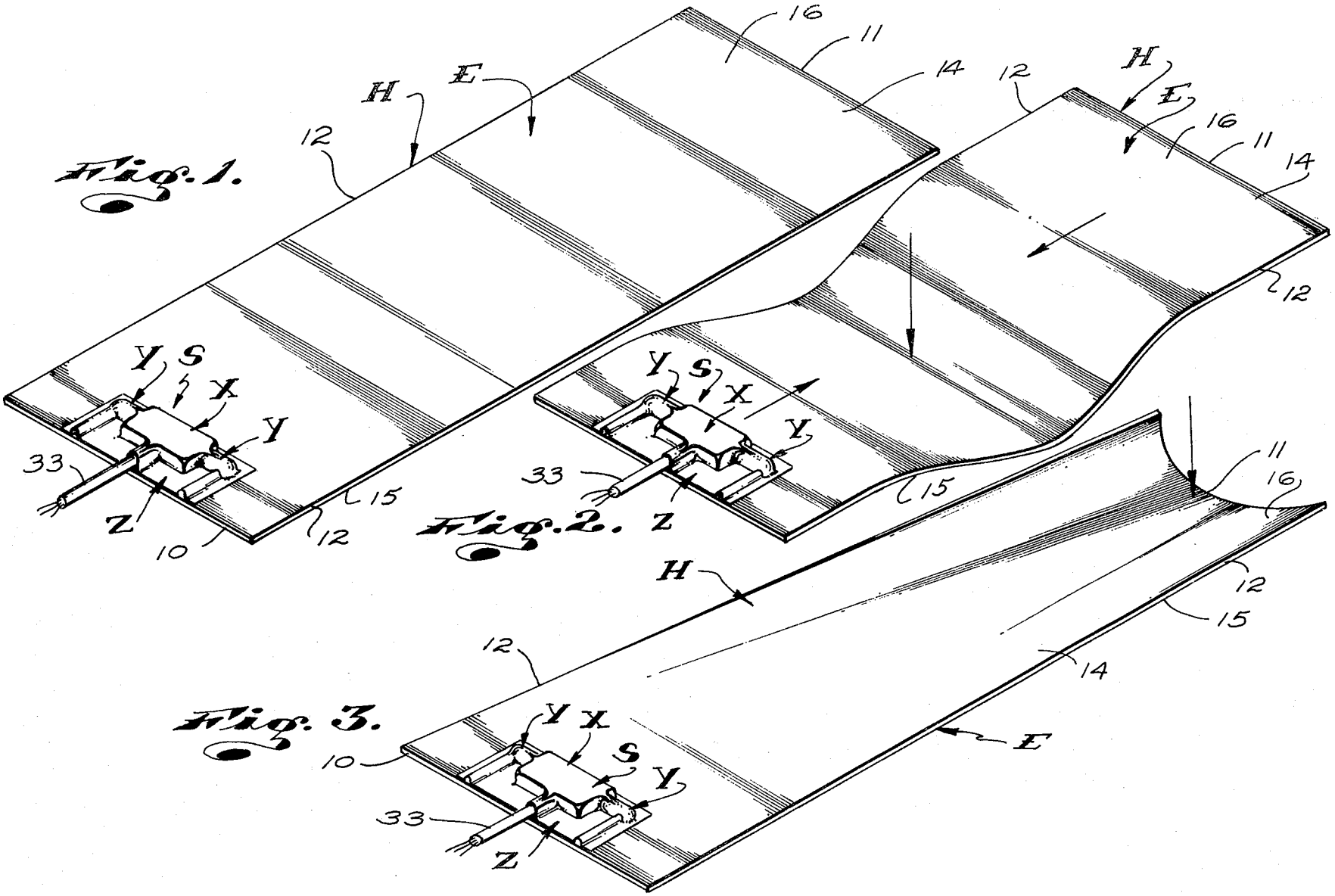
FIG. 1 is an isometric view of a heater embodying the invention.
FIG. 2 is a view similar to FIG. 1 showing the heater flexed in one direction.
FIG. 3 is a view similar to FIG. 1 showing the heater flexed in another direction.

In FIGS. 1, 2 and 3 of the drawings, the heater H embodying the present invention is shown in three different conditons or positions.

In FIG. 1 of the drawings, the heater H is shown in its normal flat condition. In FIG. 2 of the drawings, the heater is shown flexed and bent laterally, intermediate its opposite end portions by downwardly applied forces which are resolved longitudinally in and throughout the heater.

In FIG. 3 of the drawings, the heater H is shown as having one end portion bent and/or flexed on an axis angularly related to the longitudinal axis of the heater, by forces directed downwardly onto said one end portion thereof.

The heater H is an elongate, thin, flat, horizontal unit, rectangular in plan configuration. It is characterized by straight parallel front and rear ends 10 and 11, parallel side edges 12 and top and bottom surfaces 14 and 15.

The top and bottom surfaces 14 and 15 and the several edges 10, 11 and 12 are defined by a hermetically sealed envelope E of thin, flexible and pliable plastic sheeting, such as polyvinyl chloride sheeting. In the preferred carrying out of the invention, the envelope E is established of top and bottom plastic layers of sheets 16 and 17, the outside edge portions of which are welded together as indicated at 18 in FIG. 5 of the drawings. The weld 18 is a continuous weld about the perimeter of the envelope. The welded together edge portions define the noted ends 10 and 11 and the sides 12 of the envelope E.

In practice, the layers 16 and 17 can be established of a plastic sheeting which is about ten mm. thick.

Within the envelope E is a thin, flat, horizontal reinforcing plate or strate S of substantially dimensionally stable spring metal, such as spring steel, brass or aluminum. In practice, 1/32" thick sheet metal stock has been satisfactorily used to establish the strate S. The strate S has flat top and bottom surfaces 20 and 21 and is coextensive with the interior plan configuration of the envelope E. The strate is arranged within the envelope with its bottom surface 21 in flat bearing engagement with the top surface of the bottom layer 17 of the envelope.

In the preferred carrying out of the invention, the layer 17 and reinforcing strate S are cemented or bonded together by a suitable flexible cement or bonding agent, indicated at 22.

The heater next includes a heater sub-assembly A which includes a thin, flat, horizontal carrier film F of desired dielectric thermo set plastic, such as Mylar. The carrier film F has flat top and bottom surfaces 23 and 24. In practice, the film F need only be about two mm. thick. The sub-assembly A next includes an elongate electric resistance heater element R fixed to the top surface 23 of and carried by the film F. The element R is a thin, flat horizontal metal foil ribbon-like element which is of uniform thickness and lateral extent throughout most of its longitudinal extent and is arranged in a serpentine or zig-zag manner throughout the major part of the plan of the film F.

The element R is so thin and fragile that it is not self-supporting and/or capable of being manually manipulated and is therefore bonded to and carried by the film F.

In practice, the element R is established by cementing a thin metal foil, such as one mm. thick aluminum foil onto the top surface 23 of the film F by means of a suitable flexible cement 25. Thereafter, the portions of foil which are to establish the element R are masked off by a suitable masking paint or the like, applied to the top surface of the foil by printing, silk-screening or the like. Subsequently, the assembled film and painted or masked off foil is subjected to an etching bath which effects removal of the undesired foil stock and which leaves the element R on the film.

The sub-assembly A is coextensive with the strate S and is arranged atop the strate S with the top and bottom surfaces 20 and 24 of the strate and the film in flat opposing relationship. The strate and film are bonded together by suitable flexible cement as indicated at 26.

Figures 4, 5, 6, 7:
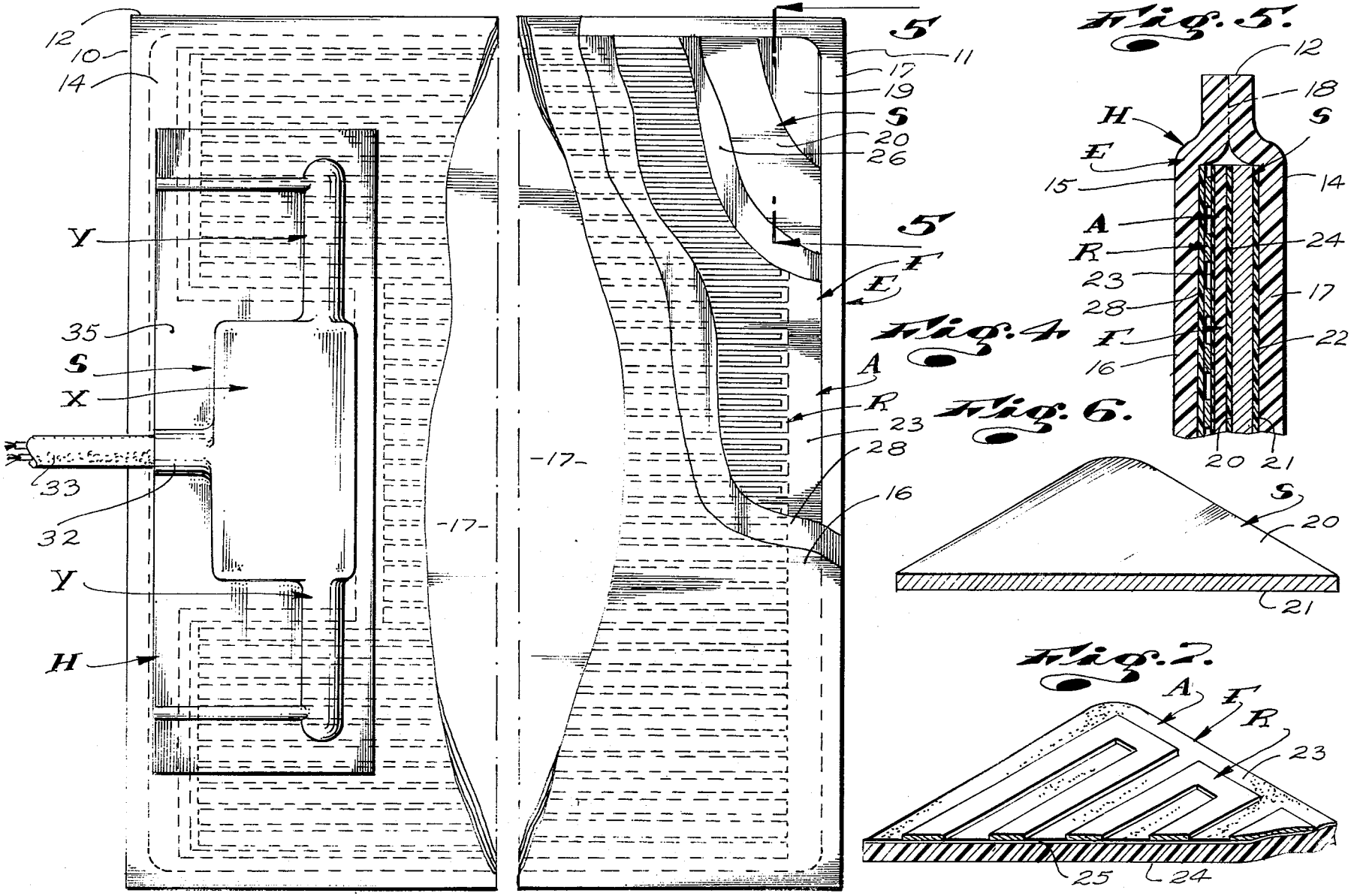
FIG. 4 is a plan view of the heater with portions broken away to better illustrate details of the construction.
FIG. 5 is an enlarged detailed view of a portion of the structure shown in FIG. 4 with portions broken away to better illustrate details of the construction.
FIG. 6 is an isometric view of a portion of the support strate.
FIG. 7 is an isometric view of a portion of the film and element sub-assembly.

The top layer 16 of the envelope E overlies the sub-assembly A and is bonded thereto by a suitable flexible cement, as indicated at 28 in FIGS. 4 and 5 of the drawings.

With the above combination and relationship of parts, it will be apparent that the thin fragile element R is bonded within the construction, between the film F and the top layer 17, in secure and stable supported condition and that the strate S, while permitting bending and flexing of the construction imparts dimensional stability into the construction which prevents it from being stretched or otherwise dimensionally distorted and/or worked in a manner which is likely to result in the element R being torn, broken, stretched or otherwise adversely worked upon.

With the heater construction thus far described, it will be apparent that the construction can be easily bent and/or flexed in manners illustrated in FIGS. 2 and 3 of the drawings or in various other manners without adverse effects.

Figures 8, 9, 10:
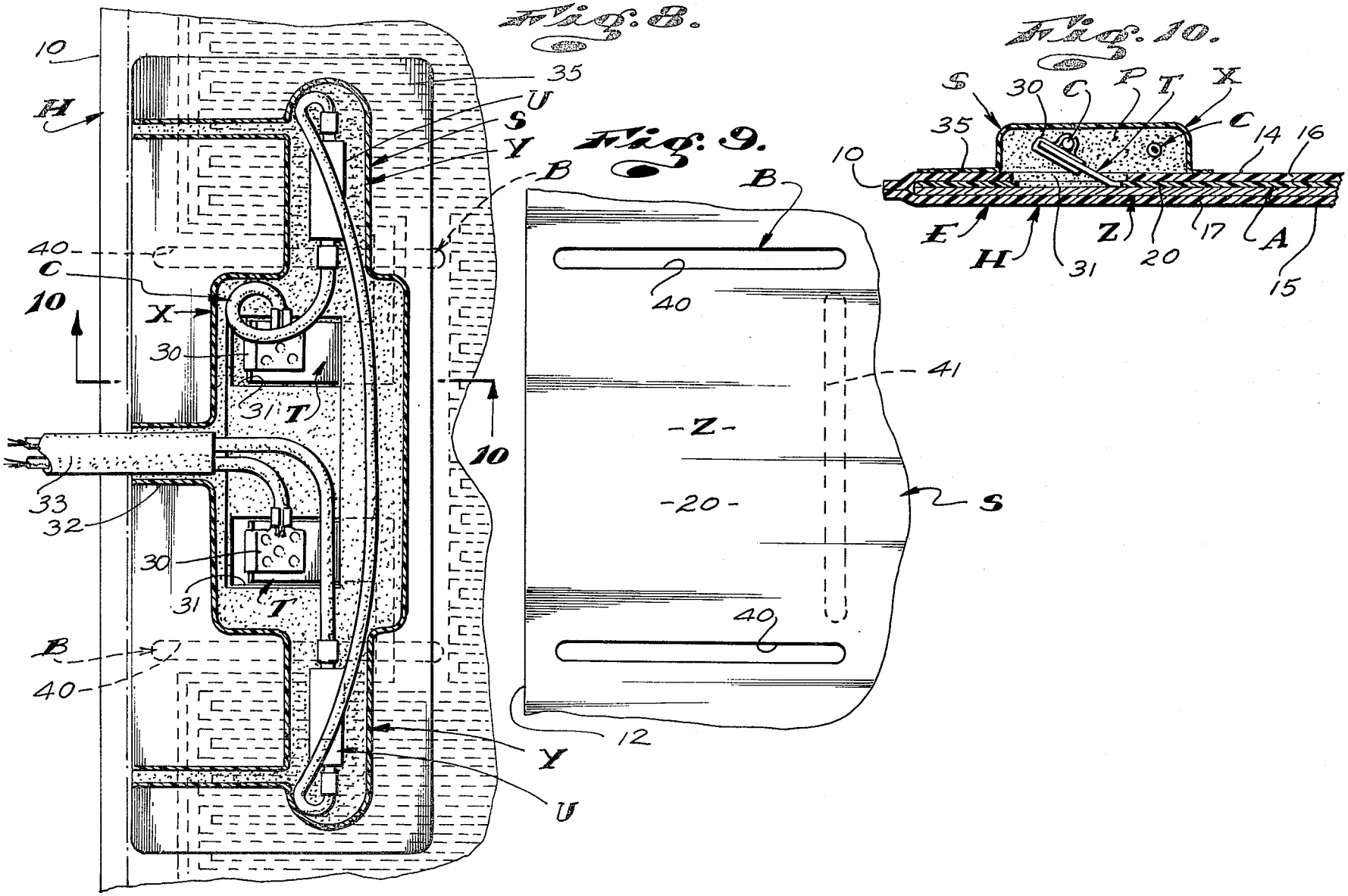
FIG. 8 is an enlarged detailed view of a portion of the structure shown in FIG. 4.
FIG. 9 is a view of another portion of the support strate.
FIG. 10 is a sectional view taken substantially as indicated by line 10—10 on FIG. 8.

In furtherance of the invention and to facilitate connecting the element R with related power supply conductors C, the element R is formed or arranged so that an area or zone Z, within the plane of the assembly, through which the element R does not extend, is established. The element R is provided with opposite end portions which enter or extend a limited distance into the zone Z to join with enlarged terminals T. The terminals T are formed integrally with the element R, on the film F, in the same manner and at the same time that the element R is formed or established. The terminals T are elongate rectangular foil parts or portions at the ends of the element R, within the zone Z. The film F is pierced or slit on three sides of the terminals to establish flexible tabs, also identified by the reference characters T. The terminal and tabs, hereinafter called "the terminal tabs T," are bent or flexed upwardly from the plane of the film to facilitate engaging clamp-type connectors 30 therewith, which connectors are fixed to or coupled with the ends of the conductors C, as shown in FIGS. 8 and 10 of the drawings.

In furtherance of the invention, the upper or top layer 16 of the envelope E, at the zone Z of the construction, is provided with a pair of spaced windows 31 through which the upwardly turned tabs T freely project.

With the above relationship of parts, it will be apparent that the conductors C, tabs T and the connectors 30 occur at and above the top plane of the envelope E, within the zone Z.

The zone Z occurs adjacent the front edge 10 about midway between the ends thereof. The zone Z is of limited planar extent and need only be large enough to accommodate the parts and/or portions of the construction noted above.

In addition to the foregoing, the invention includes temperature control means M, responsive to the temperature of the heater and operable to control the flow of current through the element R. The means M includes normally closed cartridge type thermostatic switching units U; there being one unit U connected in each conductor C. The units U are arranged in direct heat conducting contact with the top surface of the top layer 16 of the envelope E, outside the zone Z, where the element R occurs.

The normally closed thermostatic switch units U are operable to open when the temperature of the heater rises to predetermined temperatures. One unit U is preferably such that it opens when the desired operating temperature of the construction is reached and the other unit is a backup unit set to open at a slightly higher temperature than said one unit and is provided so that in the event said one unit fails to operate or open when desired, the other unit will open.

In practice, the second or other of said units U can be eliminated without departing from the spirit of the invention, but is preferably included to meet with those various safety codes which heaters of the character here concerned with are commonly required to meet.

In furtherance of the present invention, to provide a safe construction and to meet code requirements, the units U, conductors C, tabs T and connectors 30, at the top of the envelope E, are housed and protected from the outside environment by a plastic filled shell S. The shell S is a thin-walled shell of plastic material engaged over the parts and/or components to be protected and is filled with a mass or body of flexible dielectric potting material P (shown in FIGS. 10 and 11 of the drawings). The potting material P encases the various elements and parts within the shell to hold and maintain those parts and elements in desired relationship and to protect them against damage by external means and/or forces.

The shell S has an outwardly or forwardly projecting neck 32 in which the rear end portion of an elongate flexible service cable 33, from which the conductors C extend, is fixedly engaged.

In practice, the shell S has a flat rectangular mounting flange about its perimeter which establishes flat engagement on and is bonded to the top surface of the top layer 16 of the envelope E, substantially as shown.

The shell S has a large central portion X at the zone Z of the heater structure, defining a chamber in which the tabs T, connectors 30 and the major portions of the conductors C are arranged and which is filled by the potting material P. The shell also has small laterally extending wing-like branches Y extending outwardly from the zone Z over those heated portions of the construction with which the element R is related and in which the units U and short or limited portions of the conductors C are arranged and in which small volumes of the potting material P are deposited.

The metal strate S of the construction is an extremely effective and efficient heat conductor and serves to effect rapid uniform distribution of heat throughout the plane of the heater. More particularly, the strate S conducts heat to and from the zone Z of the construction at a rapid rate.

The larger and massive central portion X of the potting material filled shell S, in which the tabs T, conductors C and connectors 30 are arranged, is an effective heat sink and/or heat barrier which absorbs and/or bars substantial quantities of heat from and to the strate S at a rapid rate. The quantity of heat absorbed by the central portion X of the construction and the rate at which that heat is conducted to the portion X by the strate S is such that the portions of the heater adjacent the zone Z and with which the units U are related, are robbed of heat at such a rate that the temperature of those portions of the heater rise at a materially slower rate than the remainder of the heater. As a result of the above, the temperature of the heater construction, remote from the zone Z and the units U, can reach self-destructive limits before the portions of the heater related to the units U reach the operating temperatures of the units U.

To prevent the above noted adverse effects, the construction includes heat barrier means B about the zone Z to prevent the rapid conducting of heat through the strate S, between the zone Z and remainder of the heater construction, particularly between the zone Z and those portions of the heater construction with which the units U are related.

The heat barrier means B includes elongate slot-like openings 40 in the strate S along those sides of the zone Z adjacent which the units U occur. The openings 40 establish heat gaps in the strate S, across which heat cannot be directly conducted by the material of the strate S.

In addition to the above noted openings 40, another opening 40' shown in the dotted lines in FIG. 9 of the drawings can be provided along the other side of the zone Z, remote from the edge 10 of the strate S.

With the heat barrier means B, here provided, the strate S is substantially ineffective to conduct heat from the areas of the heater with which the units U are related to the greater mass of the construction at the zone Z. Accordingly, the temperature of the areas of the heater with which the units U are related rapidly rise and fall in substantial direct relationship to the rise and fall of the temperature throughout the portions of the heater with which the element R is related and the temperature of the zone Z of the heater is free to fluctuate or change independent of the remainder of the contruction.

In operation, should the heater be energized when there is no structure related to it to absorb and carry off the heat generated by it, the portions of the heater with which the units U are related heat at substantially the same rate as the remainder of the portions of the heater about which the element R extends and the units U open to shut off the flow of current through the element R when set operating or maximum temperatures are reached. The temperature of the zone Z during such operation does not materially alter or affect the above noted operation of the units U.

Under the same operating conditions, if the heat barrier means B was not provided, heat generated within the portions of the construction with which the units U are related would be conducted away from those portions of the construction by the strate S to the zone Z and into the greater mass of that zone, at a rate which would prevent the units U from being subjected to operating temperatures prior to that time when the portions of the heater structure remote from the zone Z and the units U reach self-destructing temperatures.

In addition to establishing heat barriers, the slots or openings 40 and 40' in the strate S impart greater flexibility to the strate about the zone A and allow for free flexing of the construction about the heavier, more massive and substantially inflexible zone Z.

In practice, when the strate S established of a material having a low index of heat conductivity the openings 40 still serve these above noted functions, though their heat barrier function is less critical.

Having described only one typical preferred form and embodiment of the invention, we do not wish to be limited to the specific details herein set forth, but wish to reserve to ourselves any modifications and/or variations that may appear to those skilled in the art and which fall within the scope of the following claims:

Having described our invention, we claim:

1. An elongate, flat rectangular laminated heater structure comprising a flat rectangular reinforcing strate of thin, flexible substantially dimensionally stable metal having flat top and bottom surfaces, opposite side edges and opposite end edges, a thin flat carrier film of dielectric plastic having flat top and bottom surfaces arranged atop and bonded to the top surface of the strate by a flexible cement, an elongate resistance heating element of thin flat metal foil ribbon arranged in a serpentine pattern throughout and occupying the major portion of the top surface of the film and bonded thereto by a flexible cement, said element has end portions extending to a portion of the top surface of the film unoccupied by the remainder of the element and integrally joined with metal foil terminals accessible at the top of the film, a flat rectangular envelope of flexible dielectric plastic sheet stock about the strate, film and the element with a lower layer adjacent the bottom surface of the strate and a top layer adjacent the top surface of the film and the element; said top layer has access openings at said terminals providing access to said terminals.

2. The heater structure set forth in claim 1 wherein the film about the terminals is cut to define tabs and said tabs are turned upwardly and project through said access openings, an elongate power supply cable with an end adjacent the top of the envelope and having conductors extending therefrom and connected with the terminal tabs, a plastic shell fixed to the top of the top layer and defining a chamber in which said end of the cable extends and in which said conductors and terminal tabs are positioned and a body of potting material in the shell and about the conductors and terminal tabs.

3. The heater structure set forth in claim 2 which further includes a normally closed thermostatic switching unit connected in each conductor and arranged in heat conducting contact with the top of said top layer above a portion of the heating element and within extensions of said shell and said body of potting materials.

4. The heater structure set forth in claim 3 wherein the strate has elongate barrier openings between the portion of the strate at which the terminal tabs occur and portions of the strate which occur in close proximity with said units whereby the strate does not conduct heat from the portions of the structure in close proximity to said units to the parts and portions of the structure adjacent the terminal tabs.

5. The heater structure set forth in claim 1 wherein the top and bottom layers of the envelope are bonded to the heating element, film and to the strate by flexible cement.

6. The heater structure set forth in claim 5 wherein the film about the terminals is cut to define tabs and said tabs are turned upwardly and project through said access openings, an elongate power supply cable with an end adjacent the top of the envelope and having conductors extending therefrom and connected with the terminals tabs, a plastic shell fixed to the top of the top layer and defining a chamber in which said end of the cable extends and in which said conductors and terminal tabs are positioned and a body of potting material in the shell and about the conductors and terminal tabs.

7. The heater structure set forth in claim 6 which further includes a normally closed thermostatic switching unit connected in each conductor and arranged in heat conducting contact with the top of said top layer above a portion of the heating element and within extensions of said shell and said body of potting materials.

8. The heater structure set forth in claim 7 wherein the strate has elongate barrier openings between the portion of the strate at which the terminal tabs occur and portions of the strate which occur in close proximity with said units whereby the strate does not conduct heat from the portions of the structure in close proximity to said units to the parts and portions of the structure adjacent the terminal tabs.

* * * * *